US010189287B2

(12) United States Patent
Sumii

(10) Patent No.: US 10,189,287 B2
(45) Date of Patent: Jan. 29, 2019

(54) PRINTING APPARATUS

(71) Applicant: SEIKO EPSON CORPORATION, Tokyo (JP)

(72) Inventor: Atsushi Sumii, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/696,425

(22) Filed: Sep. 6, 2017

(65) Prior Publication Data

US 2018/0086116 A1 Mar. 29, 2018

(30) Foreign Application Priority Data

Sep. 29, 2016 (JP) ..... 2016-191483

(51) Int. Cl.
*B41J 13/00* (2006.01)
*B41J 11/00* (2006.01)

(52) U.S. Cl.
CPC ..... *B41J 13/0009* (2013.01); *B41J 11/0005* (2013.01); *B41J 13/0045* (2013.01)

(58) Field of Classification Search
CPC ... B41J 29/38; B41J 3/60; B41J 13/103; B41J 11/007; B41J 11/04; B41J 11/0045; B41J 13/0009; B41J 13/0045; B41J 13/009; B41J 13/0027; B41J 13/03; B41J 13/10
USPC ..... 347/16, 104
See application file for complete search history.

(56) References Cited

U.S. PATENT DOCUMENTS

2012/0218361 A1 8/2012 Okuno et al.
2012/0299992 A1 11/2012 Ue et al.

FOREIGN PATENT DOCUMENTS

JP 2012-180143 A 9/2012
JP 2012-245619 A 12/2012
JP 2015-160335 A 9/2015

*Primary Examiner* — Jannelle M Lebron

(57) ABSTRACT

Provided is a printing apparatus capable of smoothly transporting a paper sheet, on a first surface of which printing is performed, with the paper sheet facing an ejection head.

7 Claims, 8 Drawing Sheets

PRINTING APPARATUS

BACKGROUND

1. Technical Field

The present invention relates to a printing apparatus which performs printing on a printing medium.

2. Related Art

As a kind of printing apparatus, an ink jet printer which includes an ejection head capable of ejecting a liquid and performs printing an image and so forth on a paper sheet by ejecting ink, which is an example of a liquid, from the ejection head to a sheet-shaped paper, which is an example of a printing medium, transported with the paper facing the ejection head has been known.

In such printers, a printing surface side of the paper sheet may swell with the ink ejected thereon and adhered thereto, and the paper sheet may curl (be bent in a curved shape). In such a case, when a paper sheet, on a first surface (a front surface) facing the ejection head of which printing is performed, is inverted and again transported to the ejection head with a second surface (a back surface) facing the ejection head (inversive transport), a curled paper sheet may come into contact with the ejection head, for example. The paper sheet in contact with the ejection head may cause a paper jam to stop transport, or may rub against the ejection head. As a result, high quality printing of an image on the paper sheet may become impossible.

To address this problem, a printing apparatus which determines an amount of ink (an amount of ejected liquid) adhering to a printing medium (a paper sheet) during printing, and suppresses curling depending on the determined amount of adhered ink has been proposed. In particular, a printing apparatus which stops transport (inversive transport) of a paper sheet for a predetermined time during inversive transport of the printing medium by pinching the paper sheet in a predetermined position in which curving is caused in a direction opposite to the direction of curling caused in a predetermined region in which the amount of adhered ink is determined to be equal to or greater than a predetermined value is proposed (for example, see JP-A-2012-245619).

In the related art printing apparatuses, however, during inversive transport of a paper sheet, a paper sheet end located downstream in an inversive transport direction from a pinch position of a paper sheet pinched in a predetermined position may be a free end cantilevered with a fixed end which is the predetermined position (the pinch position) in which the paper sheet is pinched by a pressing member (here, the inversive transport direction refers to a transport direction for inverting the paper sheet after printing on the first surface of the paper sheet in order to print the second surface. In a broader sense, the inversive transport direction is a transport direction of the paper sheet including a switchback and, in a narrower sense, it is a transport direction of the paper sheet after switchback is finished and inversion is further completed. In the invention, unless particularly stated, the broader sense is employed.) In such a case, it is difficult to suppress curling caused at the end of the paper sheet which is the free end, and the paper sheet in which curling is caused at the end thereof cannot be transported smoothly while facing the ejection head since the paper sheet end comes into contact with the ejection head during transport.

Such a situation is substantially common in printing apparatuses which include an ejection head which ejects a liquid, and an inversive transport roller which inverts and transports a paper sheet, on the facing first surface of which printing is performed with the liquid ejected from the ejection head, so that the second surface faces the ejection head.

SUMMARY

An advantage of some aspects of the invention is to provide a printing apparatus capable of smoothly transporting a paper sheet, on a first surface of which printing is performed, with the paper sheet facing an ejection head.

Hereinafter, means, operations and effects for solving the above problem will be described. A printing apparatus according to an aspect of the invention includes: an ejection head provided with a plurality of nozzles and configured to eject a liquid from the nozzles to a paper sheet to perform printing; a paper sheet transport roller configured to transport the paper sheet to an ejection position of the ejection head by rotating while pinching the paper sheet; an inverting portion configured to curve and invert the paper sheet in order to print on a second surface of the paper sheet after printing on a first surface of the paper sheet; a pinch portion configured to pinch the paper sheet with the inverting portion; and a rotation control unit configured to control rotation of the paper sheet transport roller. After printing on the first surface of the paper sheet, when the paper sheet is transported by the inverting portion, the rotation control unit performs a decurling process of the paper sheet in a state in which a length from a position in which the paper sheet is pinched by the pinch portion to a forward end of the second surface of the paper sheet is equal to or shorter than a distance from a position in which the paper sheet is pinched by the paper sheet transport roller to an uppermost stream nozzle of the ejection head.

With this configuration, since rotation stop control of the paper sheet, on the first surface (the front surface) of which printing is performed, is performed considering a distance from the pinch position to the paper sheet end (a paper sheet end on the second surface) in the inversive transport, curling caused at the paper sheet end can be effectively suppressed. That is, since the distance from the pinch position to the paper sheet end in the inversive transport is shorter than the distance from the pinch position of the paper sheet by the paper sheet transport roller to the ejection head, even if curling is caused toward the ejection head in a region of the paper sheet end from the pinch position in the inversive transport, the paper sheet, on the first surface of which printing is performed, (the second surface thereof) can be transported without rubbing against the ejection head.

It is preferable that the printing apparatus further includes a liquid amount calculating unit configured to calculate an amount of the liquid ejected from the ejection head to the first surface of the paper sheet. The inverting portion is an inversive transport roller which includes two pinch portions each of which is the pinch portion, the inversive transport roller has a first pinch position in which the paper sheet is pinched by a first pinch portion, and a second pinch position in which the paper sheet is pinched by a second pinch portion and which is located upstream of the first pinch position along the inversive transport roller. If the amount of ejected liquid calculated by the liquid amount calculating unit is equal to or greater than a predetermined threshold, the rotation control unit causes the paper sheet to be pinched in the first pinch position and performs the decurling process of the paper sheet in a state in which a first length from the first pinch position to the forward end of the second surface of the paper sheet is equal to or shorter than the distance from the position in which the paper sheet is pinched by the paper sheet transport roller to the uppermost stream nozzle of the ejection head. If the amount of ejected liquid calculated by the liquid amount calculating unit is less than the threshold, the rotation control unit causes the paper sheet to be pinched in the second pinch position and performs the decurling process of the paper sheet in a state in which a second length from the second pinch position to the forward end of the second surface of the paper sheet is longer than the first length.

With this configuration, curling caused at the paper sheet end is suppressed depending on the amount of ejected liquid and, if the paper sheet is pinched in a position upstream in the inversive transport direction, a decrease in throughput during printing can be suppressed by increasing a transport amount on the downstream side in the inverting transportation direction from the pinch position. The paper sheet is pinched in the second pinch position when not much suppression of curling is needed (when the amount of ejected liquid is less than a threshold) in order to avoid buckling of the paper sheet when the paper sheet is made to pass through the paper sheet transport roller for printing on the second surface. That is, if the paper sheet is pinched in the first pinch position when not much suppression of curling is needed, curving of the paper sheet which is greater than estimated may be caused in the direction opposite to that of the caused curling. Then, when printing is performed on the second surface, since the paper sheet end is excessively curved in the opposite direction, the paper sheet cannot be transported so that it is pinched properly in the pinch position of the paper sheet transport roller, and buckling of the paper sheet may be caused. This configuration also solves this problem.

It is preferable that the printing apparatus further includes a sheet guide configured to guide the paper sheet, which is inverted and transported by the inversive transport roller, from the second pinch position to the first pinch position in a position between the second pinch position and the first pinch position and a position facing a transport surface of the inversive transport roller. If the amount of ejected liquid calculated by the liquid amount calculating unit is less than the threshold, the rotation control unit performs the decurling process of the paper sheet in a state in which the forward end of the second surface of the paper sheet is in contact with the sheet guide.

With this configuration, since curling caused at the paper sheet end can be suppressed with the sheet guide, the paper sheet, on the first surface of which printing is performed, can be smoothly transported while facing the ejection head.

It is preferable in the printing apparatus that the rotation control unit performs rotation stop control to stop rotation of the paper sheet transport roller for a predetermined time.

With this configuration, since curling caused at the paper sheet end can be suppressed more reliably, the paper sheet, on the first surface of which printing is performed, can be smoothly transported while facing the ejection head.

It is preferable that the printing apparatus further includes a humidity detecting unit configured to detect humidity to which the paper sheet transported to the ejection head is exposed. If the humidity detected by the humidity detecting unit is less than a predetermined threshold, the rotation control unit performs rotation stop control to stop rotation of the inversive transport roller for a first standby time. If the humidity detected by the humidity detecting unit is equal to or greater than the threshold, the rotation control unit performs rotation stop control to stop rotation of the inversive transport roller for a second standby time which is shorter than the first standby time.

With this configuration, since curling caused at the paper sheet end can be suppressed depending on humidity, the paper sheet, on the first surface of which printing is performed, can be smoothly transported while facing the ejection head.

It is preferable that the printing apparatus further includes a basis weight acquisition unit configured to acquire a basis weight of the paper sheet. If the basis weight of the paper sheet acquired by the basis weight acquisition unit is equal to or greater than a predetermined threshold, the rotation control unit performs rotation stop control to stop rotation of the inversive transport roller for a predetermined time in a state in which the paper sheet is pinched in the first pinch position. If the basis weight of the paper sheet acquired by the basis weight acquisition unit is less than the threshold, the rotation control unit performs rotation stop control to stop rotation of the inversive transport roller for a predetermined time in a state in which the paper sheet is pinched in the second pinch position.

With this configuration, since curling caused in the paper sheet is suppressed depending on the basis weight of the paper sheet, the paper sheet, on the first surface of which printing is performed, can be smoothly transported while facing the ejection head. It is preferable that the printing apparatus further includes a basis weight acquisition unit configured to acquire basis weight of the paper sheet, wherein if the basis weight of the paper sheet acquired by the basis weight acquisition unit is equal to or greater than a predetermined threshold, the rotation control unit performs rotation stop control to stop rotation of the inversive transport roller for the first standby time, and if the basis weight of the paper sheet acquired by the basis weight acquisition unit is less than the threshold, the rotation control unit performs rotation stop control to stop rotation of the inversive transport roller for the second standby time which is shorter than the first standby time.

With this configuration, since curling caused in the paper sheet is suppressed depending on the basis weight of the paper sheet, the paper sheet, on the first surface of which printing is performed, can be smoothly transported while facing the ejection head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, as an embodiment of a printing apparatus, an ink jet printer which includes an ejection head, which ejects a liquid, and prints (records) images including text, figures, and so forth by ejecting ink, which is an example of the liquid, on a paper sheet, which is an example of a printing medium, will be described with reference to the drawings.

Figure 1:
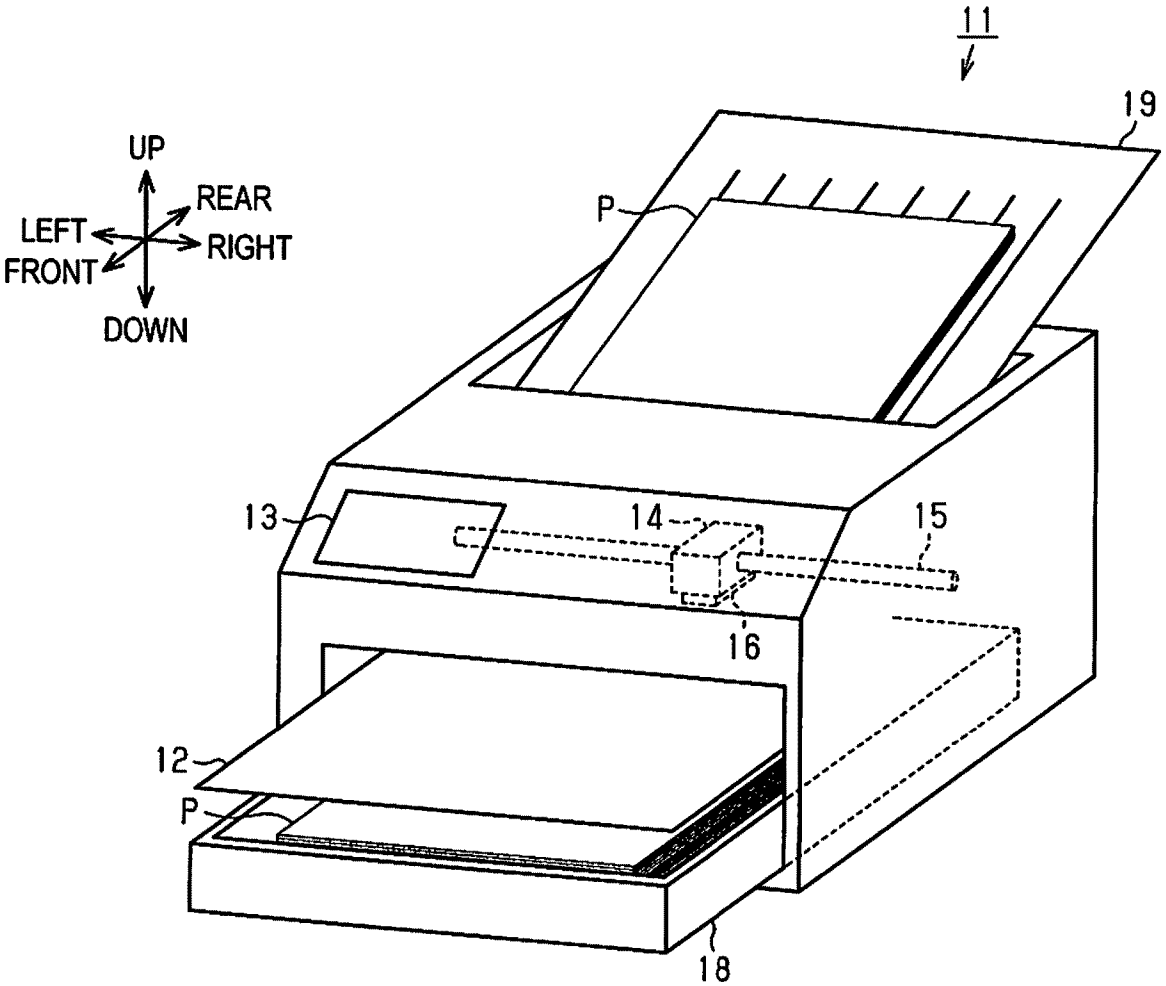
FIG. 1 is a perspective view schematically illustrating a printer as an example of an embodiment of a printing apparatus.

As illustrated in FIG. 1, a printer 11 includes a sheet feed cassette 18, a manual feed tray 19, a stacker 12, and an operation panel 13. In the following description, moving directions, mounting positions, and so forth of components of the printer 11 will be described with reference to up, down, left, right, front, and rear directions illustrated in FIG. 1. The moving directions, the mounting positions, and so forth of the components are suitably changed depending on the design.

The sheet feed cassette 18 is drawably attached to the printer 11 at the lower part of the front side of the printer 11. A plurality of paper sheets P can be accommodated in the sheet feed cassette 18. When the sheet feed cassette 18 is attached to the printer 11, printing on the paper sheet P accommodated in the sheet feed cassette 18 becomes possible. That is, when printing on the paper sheet P accommodated in the sheet feed cassette 18 is instructed from the operation panel 13 and a host apparatus (for example, a personal computer) connected to the printer 11, an automatic document feeder (ADF) 1 (see FIG. 2) which will be described later picks up one paper sheet P from the sheet feed cassette 18. The picked up paper sheet P is supplied (fed) to a predetermined transport path formed in the printer 11.

A carriage 14 which is reciprocatingly movable in a main scanning direction (a left and right direction in FIG. 1) along a guide shaft 15 extending in the left and right direction is provided on the transport path. An ejection head 16 which ejects (injects) ink is provided at the lower part of the carriage 14. A support base 17 (see FIG. 2 and other drawings) supporting the paper sheet P, which is transported while facing the ejection head 16, is disposed below the ejection head 16. Ink cartridges for containing black ink and other colors of ink which are not illustrated in the present embodiment are detachably attached above the carriage 14. The ejection head 16 is provided with nozzles through each of which the ink of each of the colors supplied from the ink cartridges is ejected at the lower part thereof, and the ink of each of the colors is ejected through each of the nozzles.

Here, on a printing surface of the paper sheet P transported in a sub scanning direction (in FIG. 1, the front and rear direction) which (here, orthogonally) crosses the main scanning direction, text and images are printed by ejecting and adhering the ink at proper timing from the ejection head 16 provided with the carriage 14 reciprocating in the main scanning direction. The paper sheet P on which text and images are printed is discharged to the outside of the printer 11, and is stacked in the stacker 12.

The manual feed tray 19 is provided as a backwardly tilting slope on a rear part of the upper side of the printer 11, and a plurality of paper sheets P can be stacked in the slope. When printing on the paper sheet P stacked in the manual feed tray 19 is instructed from the operation panel 13 or a host apparatus connected to the printer 11, an automatic document feeder (ADF) 2 (see FIG. 2) which will be described later pick up a paper sheet P from the manual feed tray 19 and supplies (feeds) the paper sheet P to the transport path. The paper sheet P supplied to the transport path is subjected to printing on the transport path in the same manner as the paper sheet P supplied from the above-described sheet feed cassette 18, and is stacked on the stacker 12 when printing is completed.

Figure 2:
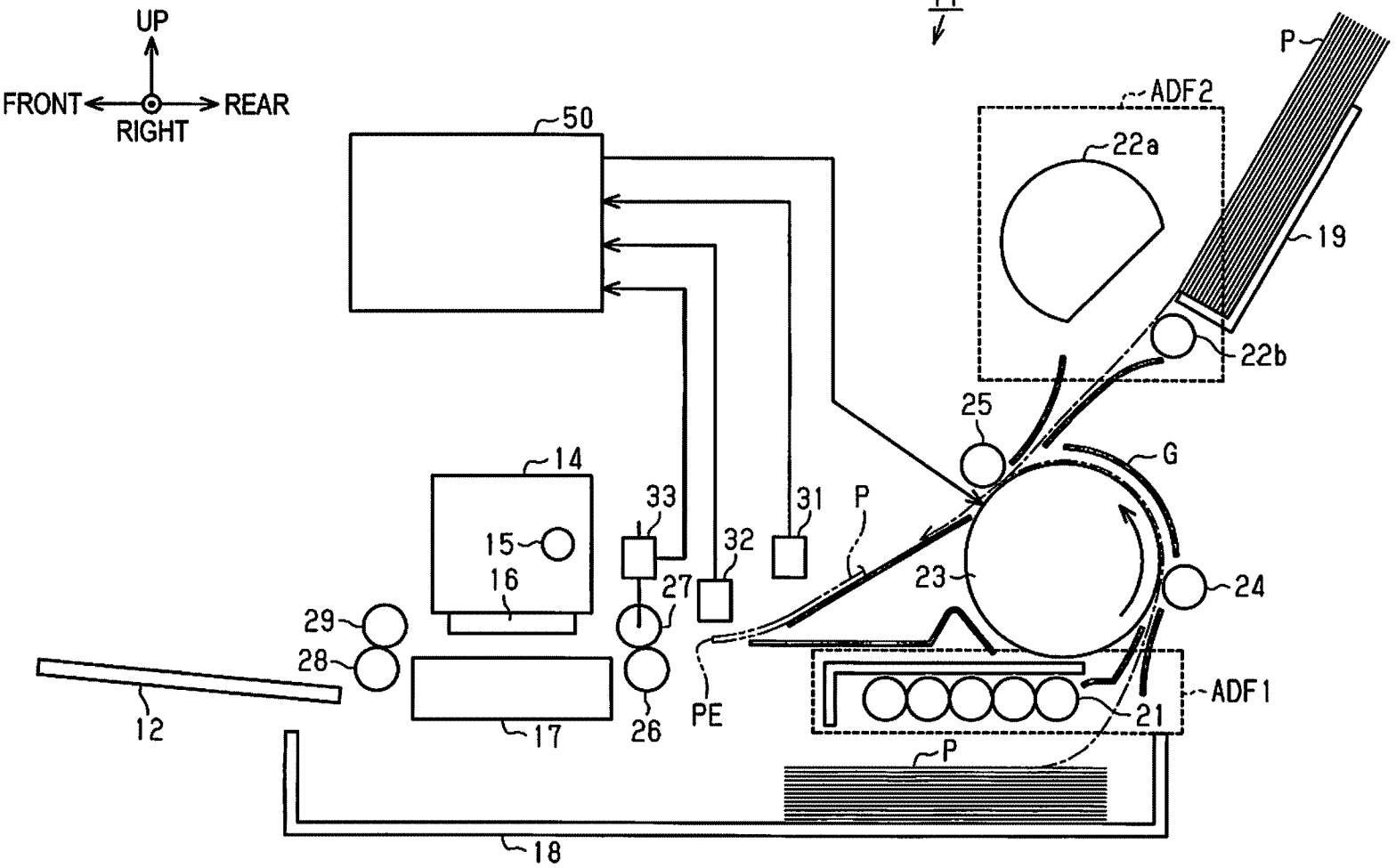
FIG. 2 is a partially cross-sectioned structural view schematically illustrating a schematic structure of the printer.

Next, the transport path of the paper sheet P will be described with reference to FIG. 2. FIG. 2 is a partially cross-sectioned schematic diagram illustrating main components of the transport path seen from the right side of the printer 11.

As illustrated in FIG. 2, the transport path of the paper sheet P includes separation rollers 21, a separation roller 22*a*, a separation driven roller 22*b*, an intermediate roller 23, intermediate driven rollers 24 and 25, a paper feed roller 26, a paper feed driven roller 27, a sheet discharge roller 28, a sheet discharge driven roller 29, and the support base 17. In addition, sheet guides which include a sheet guide G disposed between the intermediate driven roller 24 and the intermediate driven roller 25 and guide the paper sheet P to be transported along the transport path are disposed at every place.

As depicted by the dash-dot line in FIG. 2, when sheet feeding from the sheet feed cassette 18 is selected, the separation rollers 21 come into contact with the paper sheet P with an unillustrated predetermined mechanism, and one of the paper sheets P accommodated in the sheet feed cassette 18 reaches a position between the intermediate roller 23 and the intermediate driven roller 24 provided in the transport path by rotation driving of the separation rollers 21. That is, the separation rollers 21 and the predetermined mechanism for making the paper sheet P come into contact with the separation rollers 21, and so forth constitute the automatic document feeder ADF 1.

The paper sheet P supplied to the transport path by the automatic document feeder ADF 1 is transported while being press-pinched between the intermediate roller 23 and the intermediate driven roller 24 by rotation driving of the intermediate roller 23 rotating in one direction as depicted by the solid line arrow in FIG. 2. The paper sheet P is guided by the sheet guide G provided in the transport path and is moved on the transport path while being curved along an outer periphery of the intermediate roller 23, and reaches a position between the intermediate roller 23 and the intermediate driven roller 25.

Alternatively, as depicted by the dash-dot line in FIG. 2, when sheet feeding from the manual feed tray 19 is selected, the paper sheet P comes into contact with the separation roller 22*a* with an unillustrated predetermined mechanism. Then, by rotation driving of the separation roller 22*a* which is in contact with the paper sheet P, one paper sheet P stacked in the manual feed tray 19 is transported while being press-pinched between the separation roller 22*a* and the separation driven roller 22*b*, and reaches a position between the intermediate roller 23 and the intermediate driven roller 25 provided in the transportation path. That is, the separation roller 22*a*, and the mechanism for bringing the paper sheet P into contact with the separation roller 22*a*, and so forth constitute the automatic document feeder ADF 2.

In this manner, the paper sheet P is fed from the sheet feed cassette 18 or the manual feed tray 19 and reaches a position between the intermediate roller 23 and the intermediate driven roller 25, and then is transported by rotation driving of the intermediate roller 23 while being press-pinched between the intermediate roller 23 and the intermediate driven roller 25. With this transport, a paper sheet end PE of the paper sheet P on the downstream side in the transport direction reaches a position between the paper feed roller 26 and the paper feed driven roller 27. Then, the paper sheet P which has reached the position between the paper feed roller 26 and the paper feed driven roller 27 is transported to the ejection head 16 while being press-pinched between the paper feed roller 26 and the paper feed driven roller 27 by rotation driving of the paper feed roller 26, and the paper sheet end PE is inserted between the ejection head 16 and the support base 17. Therefore, in the present embodiment, the paper feed roller 26 and the paper feed driven roller 27 function as paper sheet transport rollers which transport the paper sheet P to the ejection head 16.

A lower surface of the paper sheet P of which the paper sheet end PE is inserted between the ejection head 16 and the support base 17 is supported by a base surface which becomes an upper surface of the support base 17. The base surface of the support base 17 is a surface elongated in the left and right direction and facing the ejection head 16 which moves in the main scanning direction, and the distance between the ejection head 16 and the base surface is kept constant at each movement position of the carriage 14 in the main scanning direction. Therefore, when the paper sheet P is supported (placed) on the base surface of the support base 17, the distance between the opposed surface of the paper sheet P and the ejection head 16 is kept constant, and the paper sheet P is transported forward with a first surface (a front surface) of an upper side thereof facing the ejection head 16 by rotation driving of the paper feed roller 26. During forward transport of the paper sheet P, the ink is ejected to the opposed first surface which becomes a printing surface of the paper sheet P from the ejection head 16, and printing is performed on the first surface of the paper sheet P.

Then, the paper sheet P transported to the forward by rotation driving of the paper feed roller 26 reaches a position between the sheet discharge roller 28 and the sheet discharge driven roller 29, and is transported further to the forward while being press-pinched between the sheet discharge roller 28 and the sheet discharge driven roller 29 by driving to rotate the sheet discharge roller 28. Also during the forward transport of the paper sheet P, the ink is ejected to the opposed first surface of the paper sheet P from the ejection head 16, and printing on the first surface of the paper sheet P is continued (see FIG. 3).

If the printing instruction to the paper sheet P is a single side printing, the paper sheet P, on the first surface as a single side of which printing is performed, is transported by rotation driving of the sheet discharge roller 28 while being press-pinched between the sheet discharge roller 28 and the sheet discharge driven roller 29, and is stacked in the stacker 12. If the printing instruction to the paper sheet P is a double-sided printing, inversive transport in which the paper sheet P, on the first surface of which printing is performed, is transported again to the ejection head 16 in an inverted state so that the second surface which is the rest of the surface faces the ejection head 16 is performed by rotation driving in an opposite direction of the sheet discharge roller 28 and the paper feed roller 26.

Figure 3:
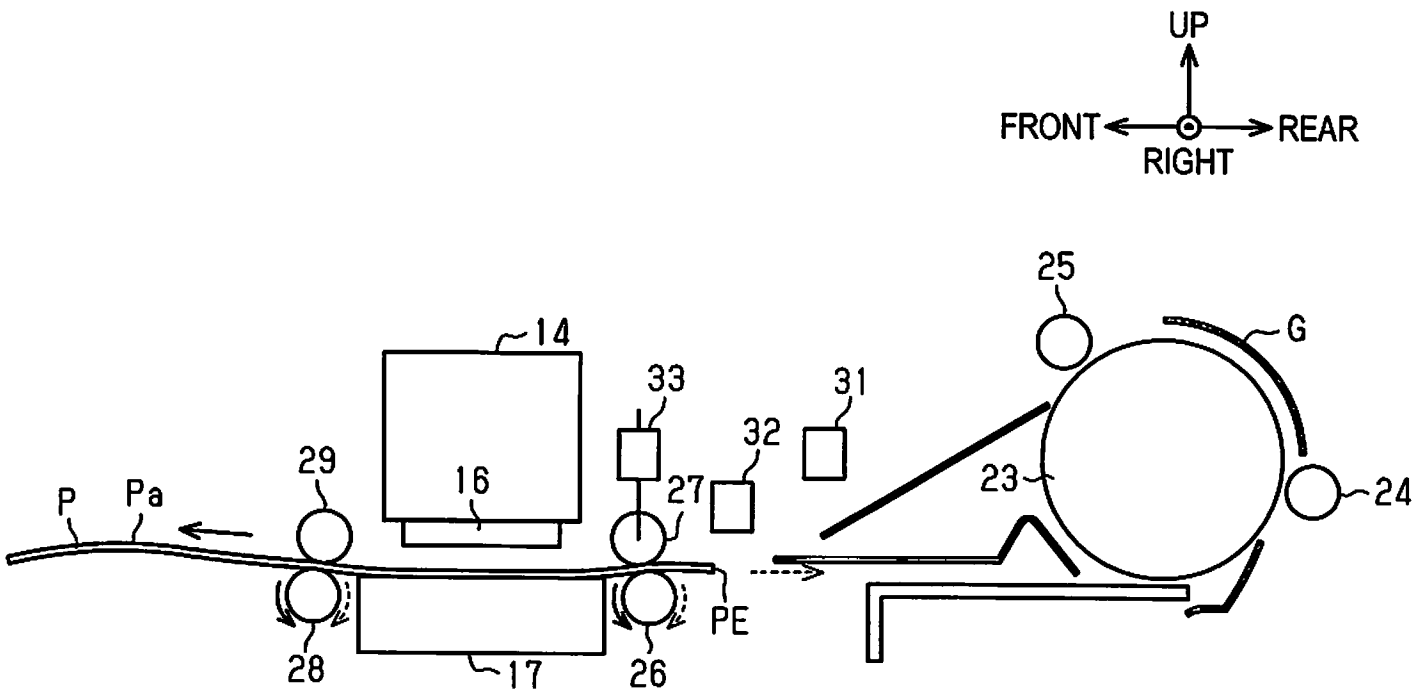
FIG. 3 is a partial structural view of the printer with a first surface of a paper sheet printed.
Figure 4:
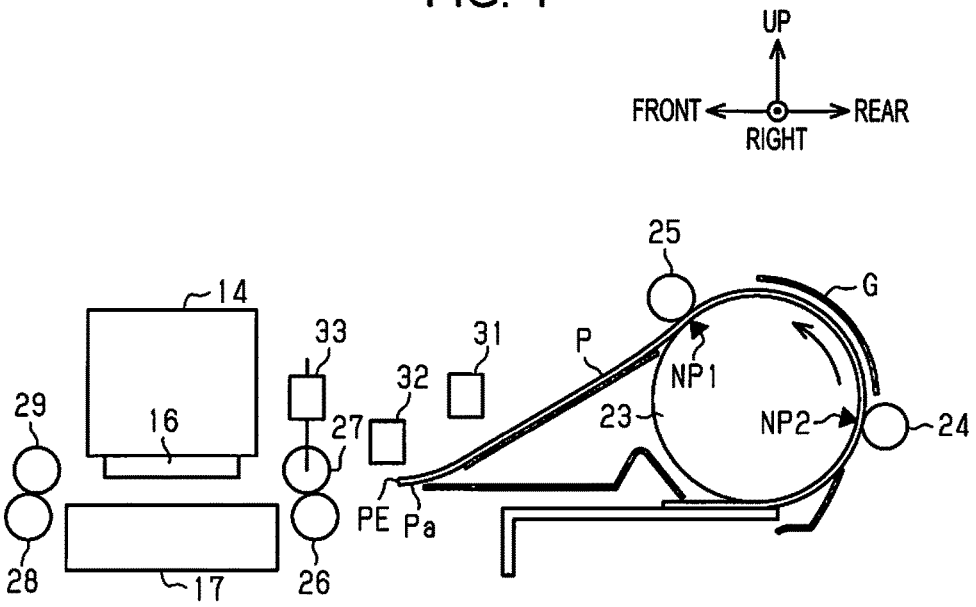
FIG. 4 is a partial structural view of the printer with the paper sheet inverted and transported.

With reference to FIGS. 3 and 4, the inversive transport of the paper sheet P will be described. First, as illustrated in FIG. 3, the paper sheet P, on the first surface Pa of which printing is performed during forward transport by forward rotation driving (in the rotational direction depicted by the solid line arrows in FIG. 3) of the paper feed roller 26 and the sheet discharge roller 28, is transported backward by reverse rotation driving (in the rotational direction depicted by the broken line arrows in FIG. 3) of the sheet discharge roller 28 and the paper feed roller 26. The paper sheet P is then transported backward along the transport path by reverse rotation driving of the paper feed roller 26 while being press-pinched (hereinafter, also referred to as "pinched") between the paper feed roller 26 and the paper feed driven roller 27, and the paper sheet end PE on the downstream side (the rear side) in the transport direction is transported toward between the intermediate roller 23 and the intermediate driven roller 24 as depicted by the broken line arrow in FIG. 3.

Next, as illustrated in FIG. 4, the paper sheet P transported backward is transported while being pinched between the intermediate roller 23 and the intermediate driven roller 24 and between the intermediate roller 23 and the intermediate driven roller 25 sequentially by rotation driving of the intermediate roller 23, and the paper sheet end PE on the downstream side in the transport direction moves toward between the paper feed roller 26 and the paper feed driven roller 27. In the paper sheet P of which the paper sheet end PE moves toward between the paper feed roller 26 and the paper feed driven roller 27, the second surface on the opposite side of the first surface Pa on which printing is already performed faces the ejection head 16, that is, the paper sheet P is inverted.

Therefore, the intermediate roller 23 and the intermediate driven rollers 24 and 25 function as inversive transport rollers which invert and transport the paper sheet P to the paper feed roller 26 and the paper feed driven roller 27 and which rotate while pinching the paper sheet P, on the first surface Pa of which printing is performed, so that the paper sheet P is again transported to the ejection head 16 in the inverted state in which the second surface of the paper sheet P faces the ejection head 16. In the present embodiment, in the inversive transport, the paper sheet P is pinched in two pinch positions by the inversive transport rollers. Specifically, the inversive transport rollers pinch the paper sheet P in a first pinch position NP1 between the intermediate roller 23 and the intermediate driven roller 25, and a second pinch position NP2 between the intermediate roller 23 and the intermediate driven roller 24 located on the upstream side of the first pinch position NP1 along the inversive transport direction. The sheet guide G is provided on the transport path for guiding the paper sheet P which is inverted and transported by the intermediate roller 23 from the second pinch position NP2 to the first pinch position NP1.

Then, in the same manner as printing on the first surface Pa, the ink is ejected from the ejection head 16 and adhered to the second surface of the paper sheet P, which is transported by the paper feed roller 26 and the paper feed driven roller 27 while facing the ejection head 16, and printing (double-sided printing) is performed. Then, the paper sheet P, on both the first surface Pa and the second surface of which printing is performed, is pinched and transported between the sheet discharge roller 28 and the sheet discharge driven roller 29 by rotation driving of the sheet discharge roller 28 and is stacked in the stacker 12.

As illustrated in FIG. 2, in the present embodiment, the printer 11 has a computer function, and includes a control unit 50 which controls a print operation with respect to the paper sheet P, and a humidity sensor 31, a paper detection sensor 32 and a sheet thickness detection sensor 33 each of which outputs electrical signals used for controlling the print operation to the control unit 50.

The humidity sensor 31 may be a sensor which can detect humidity, and is attached to a position in which humidity to which paper sheet P transported to the ejection head 16 is exposed can be detected in the printer 11. The paper detection sensor 32 may be a sensor which can detect whether or not the paper sheet remains by whether or not light is reflected, for example, and is attached to a position in which the paper sheet end PE of the paper sheet P transported along the transport path can be detected. In the present embodiment, the paper detection sensor 32 is attached on the rear side of the paper feed driven roller 27. The sheet thickness detection sensor 33 may be a sensor which optically detects a displacement amount of the paper feed driven roller 27 when the paper sheet P is pinched, for example, between the paper feed driven roller 27 and the paper feed roller 26, and the sheet thickness detection sensor 33 detects the displacement amount as a thickness of the paper sheet P.

The control unit 50 is provided in an unillustrated circuit board provided in the printer 11, and controls rotation of the intermediate roller 23 when the paper sheet P is inverted and transported in accordance with electrical signals output from each of the sensors. In the present embodiment, the control unit 50 controls a print operation in accordance with print jobs including print data and so forth input from a host apparatus, such as a personal computer. That is, the control unit 50 controls the print operation of an image on the paper sheet P by alternately repeating an ejecting operation in which the ink is ejected from the ejection head 16 at predetermined timing while causing the carriage 14 to reciprocate in the main scanning direction, and a transport operation in which rotation of the paper feed roller 26 and the sheet discharge roller 28 is controlled and the paper sheet P is transported in a sub scanning direction in a predetermined transport amount.

Figure 5:
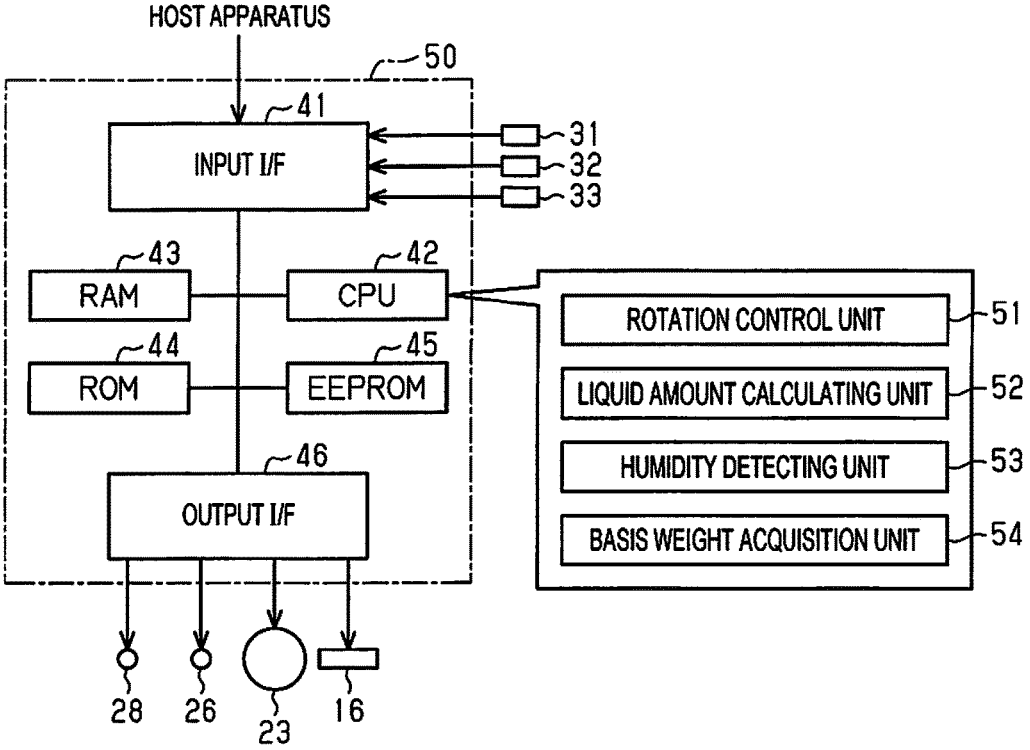
FIG. 5 is a block diagram illustrating an electric constitution related to a control unit which controls printing of the printer.

Next, a configuration of the control unit 50 will be described with reference to the drawings. As illustrated in FIG. 5, the control unit 50 includes an electric circuit which functions as a computer including a central processing unit (CPU) 42, and storage devices, such as RAM 43, RON 44, and EEPROM 45, and an electric circuit which functions as an input interface (I/F) 41 and an output interface (I/F) 46. The control unit 50 inputs predetermined electrical signals output from the host apparatus, the humidity sensor 31, the paper detection sensor 32, and the sheet thickness detection sensor 33 as data handled by the computer via the input I/F 41. The control unit 50 outputs data generated by the computer as electrical signals (driving signals) via the output I/F 46, and controls each of rotation operation of the intermediate roller 23, the paper feed roller 26, and the sheet discharge roller 28, and the ejecting operation of the ink from the ejection head 16.

In the present embodiment, in the control unit 50 with this configuration, since the CPU 42 operates based on the predetermined program stored in the storage devices, the CPU 42 functions as a rotation control unit 51, a liquid amount calculating unit 52, a humidity detecting unit 53, and a basis weight acquisition unit 54. Regarding the basis weight acquisition unit 54, the CPU 42 functions in a later-described modified example (see FIGS. 11 and 12) of the present embodiment.

The rotation control unit 51 controls the electrical signals output via the output I/F 46, and controls rotation of the intermediate roller 23 when the paper sheet P is inverted and transported along the transport path. The liquid amount calculating unit 52 calculates an amount of ejected ink which is ejected from the ejection head 16 and adheres to the paper sheet P using the print data input from the host apparatus. The humidity detecting unit 53 detects humidity to which the paper sheet P transported to the ejection head 16 is exposed in accordance with the electrical signals output from the humidity sensor 31. The basis weight acquisition unit 54 acquires the basis weight of the paper sheet P, that is, the weight per unit area, in accordance with the electrical signals output from the sheet thickness detection sensor 33.

Next, an operation of the thus-configured printer 11, that is, the rotation stop control of the intermediate roller 23 executed in the pinch positions when the paper sheet P, on the first surface Pa of which printing is performed, is inverted and transported by rotation driving of the intermediate roller 23 for double-sided printing will be described with reference to a flowchart illustrating the processing.

Figure 6:
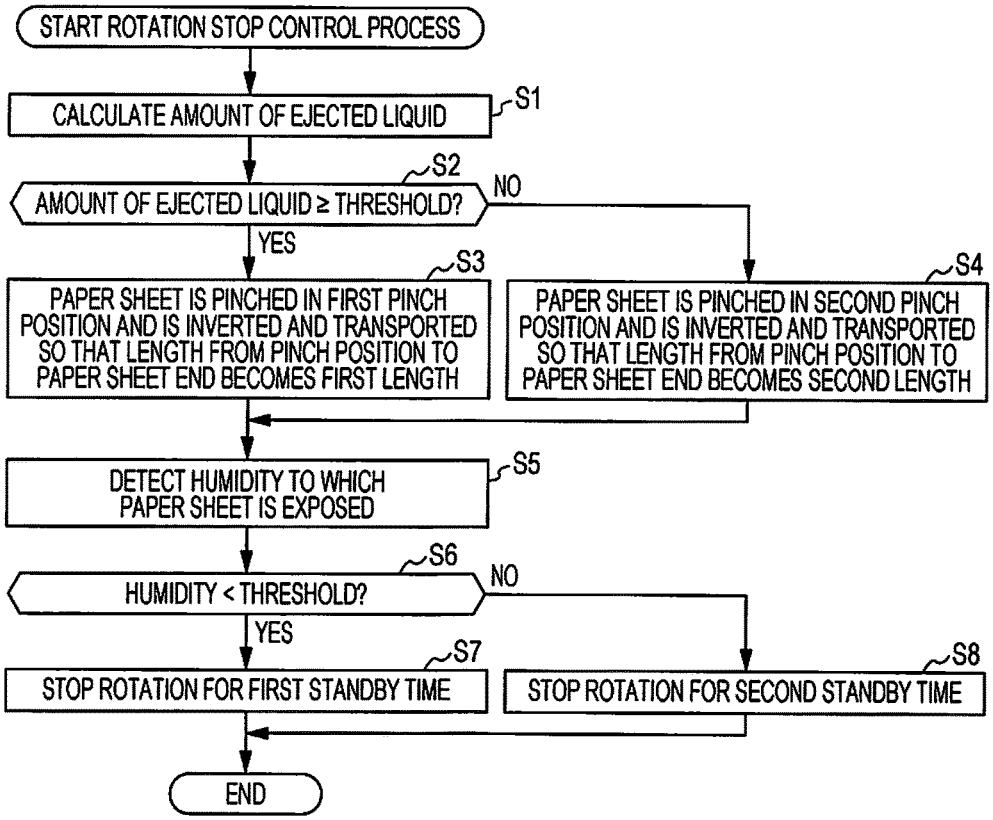
FIG. 6 is a flowchart illustrating a rotation stop control process of an inversive transport roller executed during inversive transport of a paper sheet.

As illustrated in the flowchart of FIG. 6, in this rotation stop control process, an amount of ejected liquid is first calculated in step S1. Here, the liquid amount calculating unit 52 calculates an amount of ejected ink ejected to a predetermined region of the paper sheet P using ejection data included in a print job, for example. The predetermined region may be, for example, the entire print region in which printing is performed on the first surface Pa of the paper sheet P. Alternatively, an end region (a trailing end region) in the print region of the paper sheet P from the trailing paper sheet end PE on the downstream side in the transport direction during inversive transport to a position on the upstream side with a predetermined length (for example, ¼ or ⅓ of the full length of the paper sheet P in the transport direction) on the upstream side from a trailing paper sheet end) may be employed.

Next, in step S2, it is determined whether an amount of ejected liquid is equal to or greater than a threshold. Here, a predetermined threshold of an amount of ejected liquid is stored in the storage device (for example, the RAM 43), and the rotation control unit 51 determines whether the amount of ejected liquid is equal to or greater than the threshold stored in the storage device.

If the amount of ejected liquid calculated by the liquid amount calculating unit 52 is equal to or greater than the predetermined threshold (step S2: YES), in step S3, the paper sheet is pinched in the first pinch position and is inverted and transported so that a length from the first pinch position to the paper sheet end becomes a first length. If the amount of ejected ink calculated by the liquid amount calculating unit 52 is less than the predetermined threshold (step S2: NO), in step S4, the paper sheet is pinched in the second pinch position and is inverted and transported so that a length from the second pinch position to the paper sheet end becomes a second length. Therefore, in the present embodiment, the pinch position in which the paper sheet P which is inverted and transported is pinched is changed between the second pinch position NP2 and the first pinch position NP1 depending on the amount of ejected ink.

Figure 7:
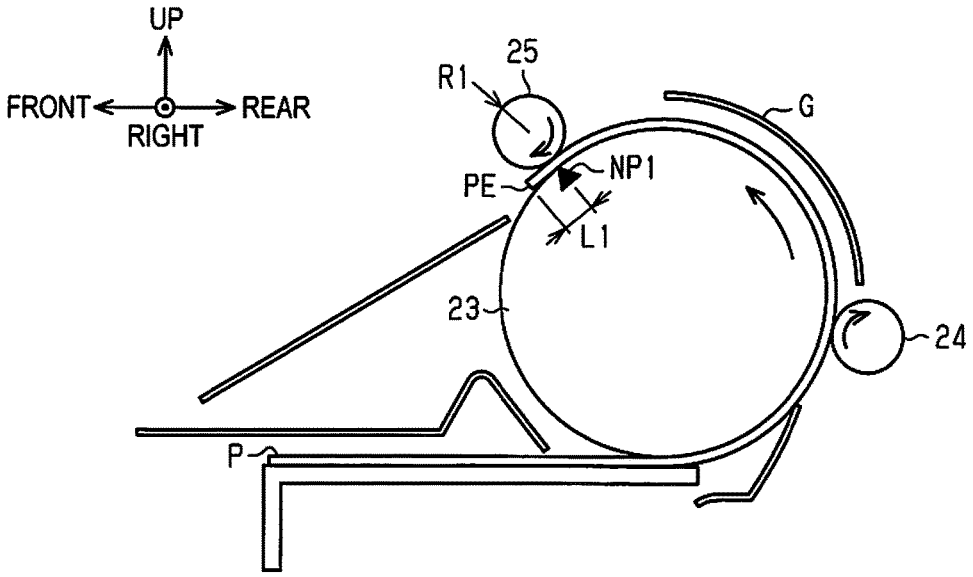
FIG. 7 is a schematic diagram illustrating a state of a paper sheet of which inversive transport is stopped by the rotation stop control process.

First, with reference to FIGS. 7 and 8, a transport condition of the paper sheet P by the processing of step S3 will be described. If the amount of ejected ink is equal to or greater than the threshold as illustrated in FIG. 7, since curling caused in the paper sheet P becomes larger, the length of the paper sheet P which curves along the intermediate roller 23 in the transport path is increased by pinching the paper sheet P in the first pinch position NP1 on the downstream side in the inversive transport direction in the inversive transport path. Therefore, decurling force with which the paper sheet P is curved in the direction opposite to the direction of the curling caused in the paper sheet P is increased (enhanced).

In the present embodiment, a first length L1 which is the length of the paper sheet P from the first pinch position NP1 to the paper sheet end PE of the paper sheet P on the downstream side in the inversive transport direction is a length R1 which is the same as the radius of the intermediate driven roller 25. That is, after the paper sheet P is pinched between the intermediate roller 23 and the intermediate driven roller 25, the rotation control unit 51 stops rotation of the intermediate roller 23 when a roller surface of the intermediate driven roller 25 is rotated in the length R1. Therefore, in the tangential direction of the intermediate roller 23 and the intermediate driven roller 25, the paper sheet P is pinched in the first pinch position NP1 in a state in which the length from the first pinch position NP1 to the paper sheet end PE of the paper sheet P on the downstream side in the inversive transport direction becomes the first length L1.

Figure 8:
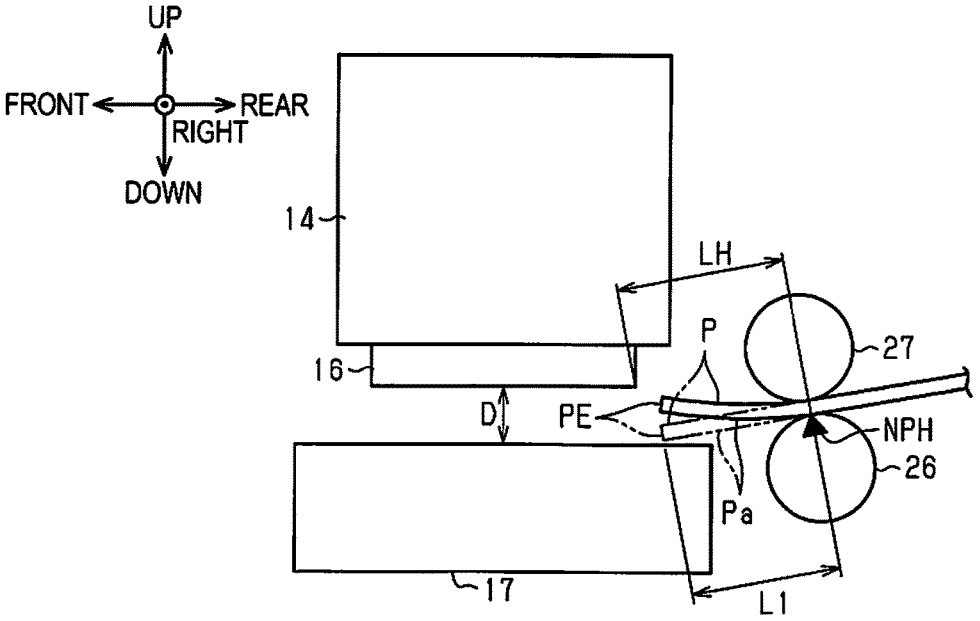
FIG. 8 is a schematic diagram illustrating a state of a paper sheet transported toward the ejection head with a paper sheet transport roller.

As illustrated in FIG. 8, in the present embodiment, the first length L1 is shorter than a length LH which is a distance from a pinch position NPH in which the paper sheet P is pinched between the paper feed roller 26 and the paper feed driven roller 27 which function as a paper sheet transport roller to the ejection head 16 in the transport direction of the paper sheet P. Since the first length L1 is equal to or shorter than the length LH, the paper sheet end PE of the paper sheet P of which the first surface Pa is subjected to printing and which is again pinched and transported between the paper feed roller 26 and the paper feed driven roller 27 is smoothly inserted in a gap D between the ejection head 16 and the support base 17.

That is, as illustrated in FIG. 8, the paper sheet P pinched in the pinch position NPH has the pinch position NPH as a fixed end and has the paper sheet end PE on the downstream side in the transport direction in the free end cantilevered with the fixed end. At this time, in the paper sheet P of which the paper sheet end PE is curled up from a state depicted by the two-dot chain line to a state depicted by the solid line in FIG. 8 due to swelling of the printed first surface Pa, since the length from the fixed end to the free end is short (equal to or shorter than the length LH), a curling amount (a raised amount) in the paper sheet end PE is suppressed. As a result, probability for which the paper sheet end PE of the paper sheet P is smoothly inserted in the gap D between the ejection head 16 and the support base 17 without coming into contact with the ejection head 16 becomes higher.

Figure 9:
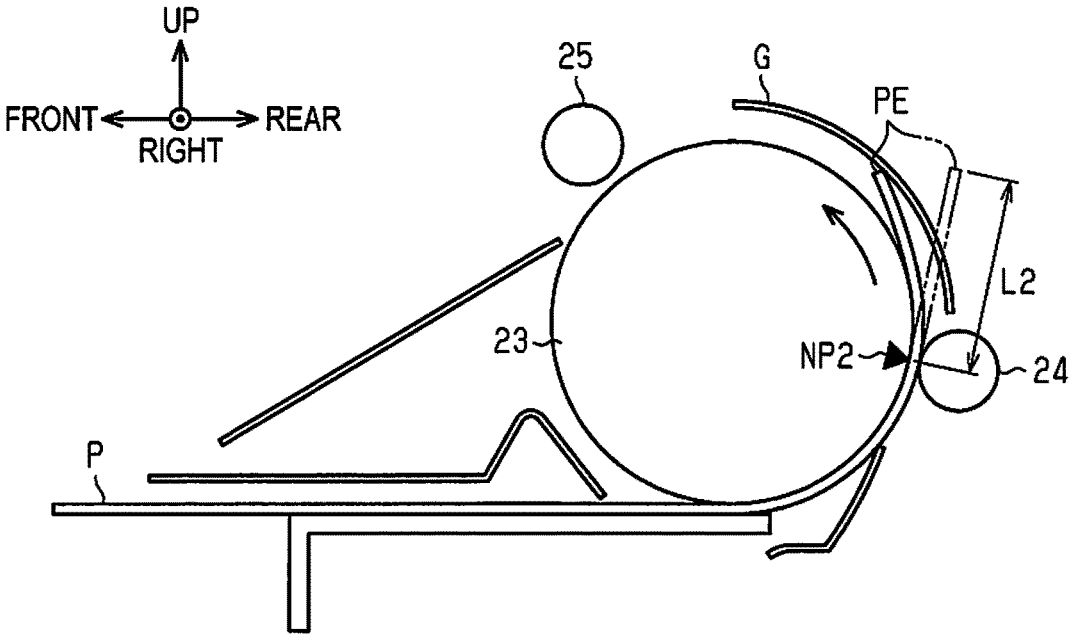
FIG. 9 is a schematic diagram illustrating a state of a paper sheet of which inversive transport is stopped by a rotation stop control process.

Next, with reference to FIGS. 9 and 10, a transport condition of the paper sheet P by the processing of step S4 will be described. As illustrated in FIG. 9, if the amount of ejected ink is less than the threshold, since the curl caused in the paper sheet P becomes smaller, the length of the paper sheet P which curves along the intermediate roller 23 in the transport path is shortened by pinching the paper sheet P in the second pinch position NP2 on the upstream side in the inversive transport direction. Therefore, decurling force with which the paper sheet P is curved in the direction opposite to the direction of the caused curling is decreased (reduced).

The length of the paper sheet P from the second pinch position NP2 to the paper sheet end PE of the paper sheet P on the downstream side in the inversive transport direction is set to a second length L2 which is longer than the first length L1 in the present embodiment. That is, after the paper sheet P is pinched between the intermediate roller 23 and the intermediate driven roller 24, the rotation control unit 51 stops rotation of the intermediate roller 23 in a state in which the roller surface of the intermediate driven roller 25 is rotated in a predetermined length which is longer than the length R1. Therefore, in the tangential direction of the intermediate roller 23 and the intermediate driven roller 24, the paper sheet P is pinched in the second pinch position NP2 in a state in which the length from the second pinch position NP2 to the paper sheet end PE of the paper sheet P on the downstream side in the inversive transport direction becomes the second length L2. That is, a transport amount of the paper sheet P from the pinch position in the inversive transport direction becomes greater (longer) when the paper sheet P is pinched in the second pinch position NP2 than when the paper sheet P is pinched in the first pinch position NP1.

In the present embodiment, as depicted by the two-dot chain line in FIG. 9, the second length L2 from the second pinch position NP2 to the paper sheet end PE is set to a length in which the paper sheet end PE comes into contact with the sheet guide G which guides the paper sheet P transported along the transport path from the second pinch position NP2 to the first pinch position NP1. Therefore, the curling caused in the end region on the side of the paper sheet and PE is decurled.

Figure 10:
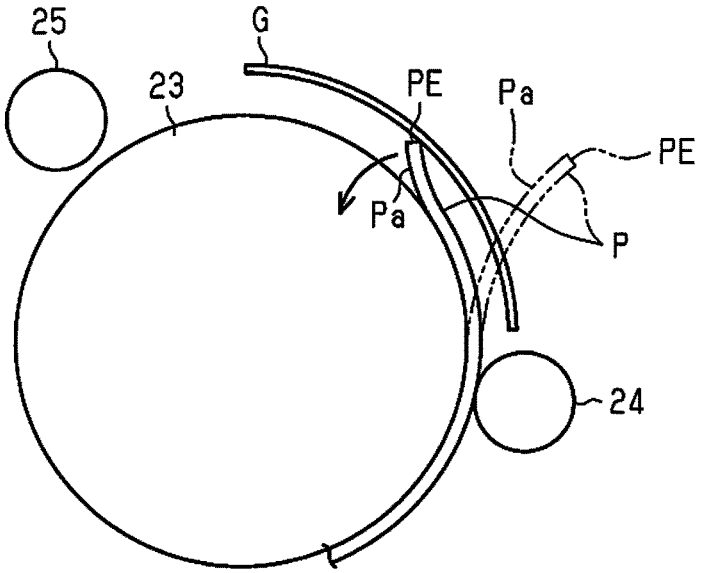
FIG. 10 is a schematic diagram illustrating a state of a paper sheet of which end is in contact with a sheet guide during inversive transport.

That is, as illustrated in FIG. 10, the paper sheet P pinched between the intermediate roller 23 and the intermediate driven roller 24 which function as the inversive transport roller is curled in a convex shape protruding toward the intermediate roller 23 due to swelling of the printed first surface Pa as depicted by the two-dot chain line in FIG. 10. At this time, when the paper sheet end PE of the paper sheet P is pressed against the intermediate roller 23 by the sheet guide G which is in contact with the paper sheet end PE, the paper sheet P is curved in the direction opposite to the caused curling as depicted by the solid line arrow in FIG. 10. As a result, the curling caused in the paper sheet P at the paper sheet end PE thereof is suppressed.

In the present embodiment, the rotation control unit 51 calculates the position of the paper sheet end PE on the downstream side in the transport direction in the inversive transport using the rotational speed and the radius of each of the paper feed roller 26 and the intermediate roller 23 after the paper detection sensor 32 (see FIG. 3) detects the trailing paper sheet end PE of the paper sheet P which is inverted and transported. Alternatively, in the present embodiment, the position of the paper sheet end PE of the paper sheet P pinched in the first pinch position NP1 or the second pinch position NP2 may be directly detected by the paper detection sensor.

Returning to FIG. 6, following the processing of step S3 or the processing of step S4, the processing for detecting humidity to which the paper sheet P is exposed is performed in step S5. Here, the humidity detecting unit 53 detects humidity to which the paper sheet P transported to the ejection head 16 is exposed using electrical signals output from the humidity sensor 31.

Next, in step S6, it is determined whether humidity is less than a threshold. Here, a predetermined threshold of humidity is stored in a storage device (for example, the RAN 43), and the rotation control unit 51 determines whether humidity is equal to or greater than the threshold stored in the storage device.

If humidity detected by the humidity detecting unit 53 is less than the predetermined threshold (step S6: YES), rotation of the intermediate roller 23 is stopped for a first standby time in step S7 and the rotation stop control process is completed. Here, the rotation control unit 51 performs rotation stop control of the intermediate roller 23 by stopping, for the first standby time, the output through the output I/F 46 of the electrical signals with which the intermediate roller 23 is driven to rotate. That is, if humidity is less than the threshold, curling caused in the paper sheet P due to swelling becomes larger. Then, by stopping the transport of the paper sheet P for the first standby time, drying time is elongated and decurling force is increased (enhanced) depending on the caused large curling.

If humidity detected by the humidity detecting unit 53 is equal to or greater than the predetermined threshold (step S6: NO), rotation of the intermediate roller 23 is stopped for a second standby time in step S8 and the rotation stop control process is completed. Here, the rotation control unit 51 performs rotation stop control of the intermediate roller 23 by stopping, for the second standby time which is shorter than the first standby time, the output through the output I/F 46 of the electrical signals with which the intermediate roller 23 is driven to rotate. That is, if humidity is equal to or greater than the threshold, curling caused in the paper sheet P due to swelling becomes smaller. Then, by stopping the transport of the paper sheet P for the second standby time which is shorter than the first standby time, drying time is shortened and decurling force is decreased (reduced) depending on the caused small curling.

Thus, in the present embodiment, in the state in which the paper sheet P which is to be inverted and transported is pinched in the pinch position, the transport stop time of the paper sheet P is changed between the first standby time and the second standby time depending on humidity to which the paper sheet P is exposed. In the present embodiment, the first standby time and the second standby time for which the intermediate roller 23 is stopped during inversive transport of the paper sheet P are stored in the storage device (for example, the RAM 43). The rotation control unit 51 loads the time stored in the storage device during the processing of step S7 or S8, and performs either one of the rotation stop control processes.

According to the above embodiment, the following effects can be obtained.

(1) In the paper sheet P, on the first surface Pa (the front surface) of which printing is performed, curling caused in the paper sheet end PE is suppressed depending on the pinch position in the inversive transport. Therefore, (the second surface of) the paper sheet P, on the first surface Pa of which printing is performed, can be smoothly transported while facing the ejection head 16.

(2) Curling caused in the paper sheet end PE is suppressed depending on the amount of ejected ink, and a decrease in throughput during printing can be suppressed by increasing the transport amount to the downstream side in the inversive transport direction from the pinch position (the second pinch position NP2) if the paper sheet P is pinched in a position upstream in the inversive transport direction.

(3) Since curling which occurs in the paper sheet and PE can be suppressed by the sheet guide G, the paper sheet P, on the first surface Pa of which printing is performed, can be smoothly transported while facing the ejection head 16.

(4) Since curling which occurs in the paper sheet end PE can be suppressed depending on humidity, the paper sheet P, on the first surface Pa of which printing is performed, can be smoothly transported while facing the ejection head 16.

The above embodiment may be modified as follows. In the above embodiment, the first length L1 from the first pinch position NP1 to the paper sheet end PE may be a length equal to or shorter than the gap D between the ejection head 16 and the support base 17. In this case, even if the paper sheet end PE is curled up to 45 degrees with respect to the transport direction from the pinch position, since the curling amount (the raised amount) in the paper sheet end PE is equal to or smaller than the gap D, the paper sheet and PE is reliably inserted in the gap D.

In the above embodiment, the humidity sensor 31 and the humidity detecting unit 53 which detect humidity to which the paper sheet P on which printing is performed is exposed do not necessarily to be provided. For example, if a change in humidity of the paper sheet P is suppressed (for example, if the printer 11 is set in an atmosphere of constant humidity) it is not necessary to detect humidity. In such a case, the time in which the intermediate roller 23 stops rotation in the inversive transport may be either one of the first standby time and the second standby time, or may be predetermined time determined separately from the first standby time or the second standby time, for example.

In the above embodiment, if the amount of ejected ink is less than a threshold, the rotation control unit 51 does not necessarily have to perform rotation stop control of the intermediate roller 23 in the state in which the paper sheet end PE of the paper sheet P in the inversive transport direction is in contact with the sheet guide G. That is, the second length L2 of the paper sheet P from the second pinch position to the paper sheet end PE in the inversive transport direction of the paper sheet P may be a length which is not in contact with the sheet guide G as long as the second length L2 is longer than the first length L1. If the amount of ejected ink is less than a threshold, since the curling which occurs in the paper sheet end PE is small, decurling using the sheet guide G is not necessarily.

In the above embodiment, the second length L2 from the second pinch position NP2 to paper sheet end PE in the inversive transport direction of the paper sheet P pinched in the second pinch position NP2 is desirably longer than first length L1, and is shorter than the length LH of the distance from the pinch position NPH to the ejection head 16 in the transport direction of the paper sheet P. This avoids rubbing of the paper sheet end PE against the ejection head 16. If decurling is performed using the sheet guide G, the second length L2 may be longer than the length LH of the distance from the pinch position NPH to the ejection head 16 in the transport direction of the paper sheet P. That is, since the paper sheet end PE is pressed by the sheet guide G so that the paper sheet end PE is decurled, rubbing of the paper sheet end PE against the ejection head 16 is avoided. In addition, since the paper sheet end PE is located closer to the ejection head 16, transport time of the paper sheet can be shortened, and throughput improves.

In the above embodiment, if the amount of ejected ink ejected to the paper sheet P is less than a predetermined threshold, rotation stop control of the intermediate roller 23 may be performed in a state in which the second length L2 from the second pinch position NP2 in the inversive transport direction of the paper sheet P pinched in the second pinch position NP2 to the paper sheet end PE becomes the same length with the first length L1.

In the above embodiment, three or more intermediate driven rollers may be provided and the paper sheet P may be pinched between the intermediate roller 23 and the intermediate driven rollers in three or more pinch positions during inversive transport. In this case, two arbitrary pinch positions among a plurality of pinch positions may be defined as the first pinch position NP1 and the second pinch position NP2 in the above embodiment.

In the above embodiment, a single intermediate driven roller may be provided, and the paper sheet P may be pinched between the intermediate roller 23 and the intermediate driven roller in a single pinch position in the inversive transport. In this case, the rotation stop control process of the intermediate roller 23 is performed in a state in which the length of the paper sheet from a single pinch position to the paper sheet and PE in the inversive transport direction becomes the first length L1 in the above embodiment.

In the above embodiment, as illustrated in FIG. 6, the rotation stop control process in which rotation of the intermediate roller 23 is stopped in the state in which the paper sheet P is pinched in the first pinch position NP1 or the second pinch position N2 depending on the amount of ejected ink on the paper sheet P. However, the pinch position may be changed irrespective of the amount of ejected ink. For example, the pinch position may be changed depending on the basis weight of the paper sheet P.

Figure 11:
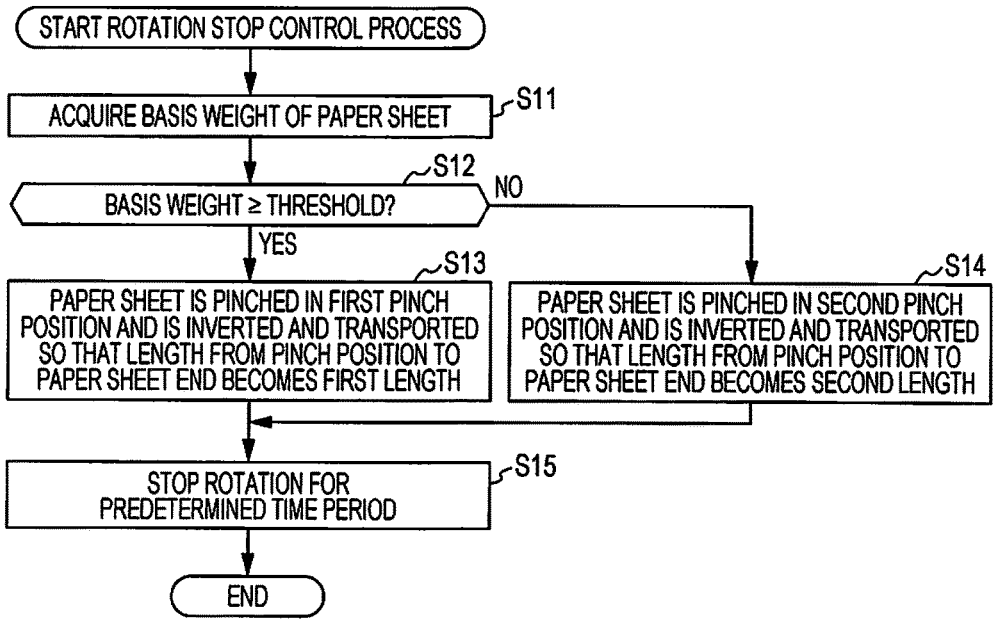
FIG. 11 is a flowchart illustrating a rotation stop control process in which a pinch position is determined in accordance with basis weight of a paper sheet.

This modified example will be described with reference to a flowchart illustrating a rotation stop control process of the intermediate roller 23 as an operation thereof. As illustrated in the flowchart of FIG. 11, in the rotation stop control process of this modified example, the basis weight of the paper sheet P is acquired first in step S11. Here, the weight per unit volume of the paper sheet P fed in the printer 11 is stored in the storage device in advance. The basis weight acquisition unit 54 acquires the basis weight of the paper sheet P by calculating the weight per unit area of the paper sheet P based on the thickness of the paper sheet P acquired from the electrical signals output from the sheet thickness detection sensor 33 and the weight per unit volume of the paper sheet P stored in the storage device in advance.

Next, it is determined whether the basis weight is equal to or greater than a threshold in step S12. Here, a predetermined threshold of the basis weight is stored in the storage device (for example, the RAM 43), and the rotation control unit 51 determines whether the basis weight is equal to or greater than the threshold stored in the storage device.

If the basis weight acquired by the basis weight acquisition unit 54 is equal to or greater than the predetermined threshold (step S12: YES), in step S13, the paper sheet is pinched in a first pinch position and is inverted and transported so that a length from the first pinch position to the paper sheet end becomes a first length. That is, if the basis weight is equal to or greater than the threshold, since the rigidity or stiffness of the paper sheet P is high, decurling force with respect to the caused curling becomes larger irrespective of the amount of ejected liquid. Then, by pinching the paper sheet P in the first pinch position NP1 on the downstream side in the inversive transport direction in the inversive transport path, decurling force with which the paper sheet P is curved in the direction opposite to the direction of the caused curling is increased (enhanced).

If the basis weight acquired by the basis weight acquisition unit 54 is less than the predetermined threshold (step S12: NO), in step S14, the paper sheet is pinched in a second pinch position and is inverted and transported so that a length from the second pinch position to the paper sheet end becomes the second length. That is, if the basis weight is less than the threshold, since the rigidity or stiffness of the paper sheet P is low, decurling force with respect to the caused curling becomes smaller irrespective of the amount of ejected liquid. Then, by pinching the paper sheet P in the second pinch position NP2 on the upstream side in the inversive transport direction in the inversive transport path, decurling force with which the paper sheet P is curved in the direction opposite to the direction of the caused curling is decreased (reduced).

Following the processing of step S13 or the processing of step S14, rotation of the intermediate roller 23 is stopped for predetermined time in step S15, and the rotation stop control process in this modified example is completed. In this modified example, the predetermined time is stored in the storage device (for example, the RAN 43) as the time in which the intermediate roller 23 is stopped during inversive transport of the paper sheet P. The rotation control unit 51 loads the time stored in the storage device during the processing of step S15, and performs the rotation stop control process of the intermediate roller 23.

Therefore, in this modified example, the pinch position in which the paper sheet P which is inverted and transported is pinched is changed between the second pinch position NP2 and the first pinch position NP1 depending on the basis weight of the ink. In this modified example, the predetermined time may be the first standby time or the second standby time in the above embodiment. In the processing of step S15, if the humidity to which the paper sheet P detected by the humidity detecting unit 53 in the above embodiment is exposed is less than the predetermined threshold, the predetermined time may be the first standby time and, if the humidity is equal to or greater than the predetermined threshold, the predetermined time may be the second standby time.

In the modified example illustrated in FIG. 11, the following effect is provided in addition to the effect (1) in the above embodiment.

(5) Since curling caused in the paper sheet P is suppressed depending on the basis weight of the paper sheet P, the paper sheet P, on the first surface Pa of which printing is performed, can be smoothly transported while facing the ejection head 16.

Alternatively, in the above embodiment, the time for which the rotation of the intermediate roller 23 is stopped may be changed depending on the basis weight of the paper sheet P irrespective of the amount of ejected ink and the humidity to which the paper sheet P is exposed.

Figure 12:
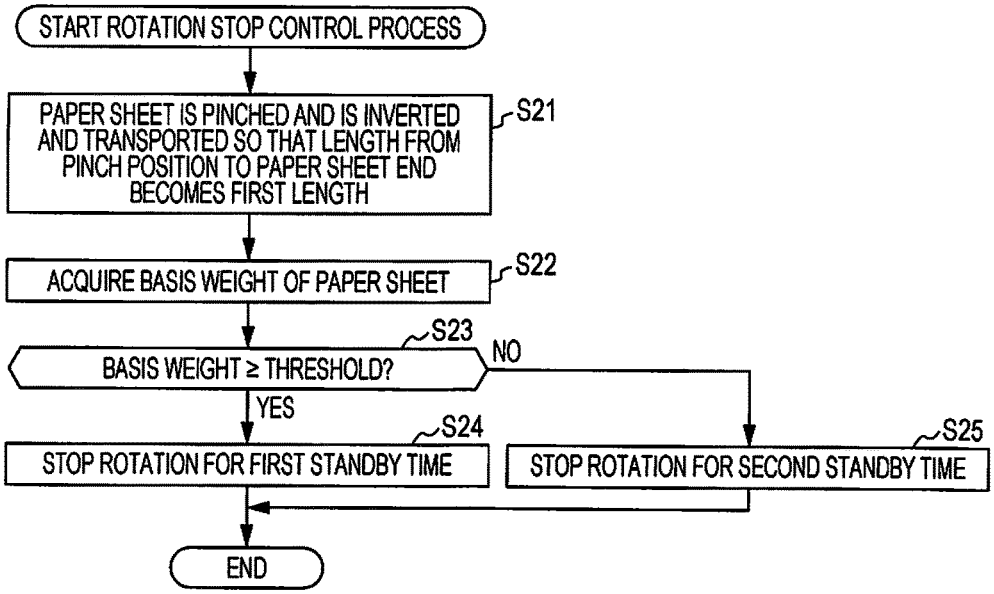
FIG. 12 is a flowchart illustrating a rotation stop control process which stops for time in accordance with basis weight of a paper sheet.

This modified example will be described with reference to a flowchart illustrating a rotation stop control process of the intermediate roller 23 as an operation thereof. As illustrated in the flowchart of FIG. 12, in the rotation stop control process of this modified example, first in step S21, the paper sheet is pinched and is inverted and transported so that a length from the pinch position to the paper sheet end becomes the first length. In this modified example, in each pinch position in which the paper sheet P is pinched (for example, the pinch position between the intermediate roller 23 and the intermediate driven roller 24 in the above embodiment), the rotation control unit 51 controls rotation of the intermediate roller 23 so that the paper sheet P stops in the state in which the length from the pinch position to the paper sheet end PE on the downstream side in the inversive transport direction becomes the first length L1.

Next, in step S22, the basis weight of the paper sheet is acquired. Here, the weight per unit volume of the paper sheet P to which paper is fed in the printer 11 is stored in the storage device in advance. Then basis weight acquisition unit 54 acquires the basis weight of the paper sheet P by calculating the weight per unit area of the paper sheet P based on the thickness of the paper sheet P acquired from the electrical signals output from the sheet thickness detection sensor 33, and the weight per unit volume of the paper sheet P stored in the storage device in advance.

Next, in step S23, it is determined whether the basis weight is equal to or greater than a threshold. Here, a predetermined threshold of the basis weight is stored in the storage device (for example, the RAM 43), and the rotation control unit 51 determines whether the basis weight is equal to or greater than the threshold stored in the storage device.

If the basis weight acquired by the basis weight acquisition unit 54 is equal to or greater than the predetermined threshold (step S23: YES), rotation of the intermediate roller 23 is stopped for the first standby time in step S24 and the rotation stop control process is completed. Here, the rotation control unit 51 performs rotation stop control of the intermediate roller 23 by stopping, for the first standby time, the output through the output I/F 46 of the electrical signals with which the intermediate roller 23 is driven to rotate. That is, if the basis weight is equal to or greater than the threshold, since the rigidity or stiffness of the paper sheet P is high, decurling force with respect to the caused curling becomes larger irrespective of the amount of ejected liquid or the humidity. Then, by stopping the transport of the paper sheet P for the first standby time, drying time is elongated and decurling force of the caused curling is increased (enhanced).

If the basis weight acquired by the basis weight acquisition unit 54 is less than the predetermined threshold (step S23: NO), rotation of the intermediate roller 23 is stopped for the second standby time in step S25 and the rotation stop control process is completed. Here, the rotation control unit 51 performs rotation stop control of the intermediate roller 23 by stopping, for the second standby time which is shorter than the first standby time, the output through the output I/F 46 of the electrical signals with which the intermediate roller 23 is driven to rotate. That is, if the basis weight is less than the threshold, since the rigidity or stiffness of the paper sheet P is low, decurling force with respect to the caused curling becomes smaller irrespective of the amount of ejected liquid or the humidity. Then, by stopping the transport of the paper sheet P for the second standby time which is shorter than the first standby time, drying time is shortened and decurling force of the caused curling is decreased (reduced).

Thus, in this modified example, in the state in which the paper sheet P which is to be inverted and transported is pinched in the pinch position, the transport stop time of the paper sheet P is changed between the first standby time and the second standby time depending on the basis weight of the paper sheet P. The first standby time and the second standby time in this modified example may be the first standby time and the second standby time in the above embodiment, or time different from those in the above embodiment.

In this modified example, in the same manner as in the modified example illustrated in FIG. 11, for example, the pinch position of the paper sheet P may be changed among a plurality of pinch positions (for example, the first pinch position NP1 and the second pinch position NP2) depending on the basis weight. In this case, if the basis weight is equal to or greater than a threshold, the paper sheet P is pinched in the first pinch position NP1 and rotation of the intermediate roller 23 is stopped for the first standby time, and if the basis weight is less than the threshold, the paper sheet P is pinched in the second pinch position NP2 and rotation of the intermediate roller 23 is stopped for the second standby time.

In the modified example illustrated in FIG. 12, the following effect is provided in addition to the effect (1) in the above embodiment.

(6) Since curling caused in the paper sheet P is suppressed depending on the basis weight of the paper sheet P, the paper sheet P, on the first surface Pa of which printing is performed, can be smoothly transported while facing the ejection head 16.

In the modified example illustrated in FIG. 11 or FIG. 12, the basis weight acquisition unit 54 does not necessarily have to acquire the basis weight of the paper sheet P using electrical signals output from the sheet thickness detection sensor 33. For example, the paper sheet P fed from the sheet feed cassette 18 and the paper sheet P fed from the manual feed tray 19 may be of the predetermined type and thickness, respectively. In such a case, when either of the paper sheet P of the sheet feed cassette 18 or the paper sheet P of the manual feed tray 19 is designated to be fed in accordance with the print job, the basis weight acquisition unit 54 may acquire the basis weight of the paper sheet P to be printed from the type and thickness of the paper sheet P designated to be fed in accordance with the print job.

In the above embodiment, the rotation stop control process illustrated in the flowchart of FIG. 6 may be performed when the basis weight of paper sheet P acquired by the basis weight acquisition unit 54 is in a predetermined range between a first threshold and a second threshold which is larger than the first threshold, for example. Further, in this case, if the basis weight of the paper sheet P acquired by the basis weight acquisition unit 54 is less than the first threshold, the transport stop time of the paper sheet P in the modified example illustrated in the flowchart of FIG. 12 may be changed and, if the basis weight of the paper sheet P acquired by the basis weight acquisition unit 54 is larger than the second threshold, the pinch position of the paper sheet in the modified example illustrated in the flowchart of FIG. 11 may be changed. For example, since a paper sheet P with small basis weight like tracing paper has low stiffness, magnitude of decurling can be controlled more precisely by adjusting the drying time than adjusting the length to be curved. For example, since a paper sheet P with large basis weight like cardboard has high stiffness, magnitude of decurling can be controlled more precisely by adjusting the length to be curved than adjusting the drying time.

In the above embodiment, the configuration of the printer 11 is not limited to a serial head configuration in which the ejection head 16 is provided in the carriage 14 reciprocating in the main scanning direction which crosses the transport direction of the paper sheet P. For example, the printer 11 may have a linear head configuration provided with an ejection head 16 capable of ejecting ink across substantially the entire area thereof in the width direction which (orthogonally) crosses the transport direction of the paper sheet P.

In the above embodiment, the supply source of the ink ejected from the ejection head 16 is not limited to the ink cartridge attached to the upper portion of the carriage 14, and may be an external type ink container (ink tank) provided outside of the printer 11, for example. If an external type ink container is employed, since ink capacity can be increased, a greater amount of ink can be ejected from the ejection head 16.

In the above embodiment, the printer 11 as a printing apparatus may be a fluid ejection apparatus configured to print by ejecting or injecting a fluid other than ink (which includes a liquid, a liquid material in which particles of a functional material are dispersed or mixed in a liquid, a fluid body like gel, and a solid material which may be made to flow and be ejected as a fluid). For example, the printer 11 may be a fluid ejection apparatus configured to print by ejecting a liquid material which includes, in the form of dispersion or dissolution, an electrode material, a coloring material (a pixel material) and the like used for manufacturing a liquid crystal display, an electroluminescence (EL) display, and a surface-emitting display, for example. The printer 11 may further be a fluid ejection apparatus which ejects a fluid body, such as gel (for example, physical gel). The invention is applicable to any one of these fluid ejection apparatuses. In this specification, a "fluid" is a concept which excludes a fluid constituted only by gas and a fluid may include a liquid (which includes an inorganic solvent, an organic solvent, a solution, liquefied resin, liquefied metal (metal melt) and the like), a liquid material, and a fluid body, for example.

In the above embodiment, the paper sheet may be pinched using an elastic member, such as resin, instead of the intermediate driven rollers 25 and 26.

In the above embodiment, the decurling process of the paper sheet may be implemented by causing the paper sheet to stand by, or may be implemented by causing the paper sheet to be transported at a lower speed than the transport speed during inversion.

The entire disclosure of Japanese Patent Application No. 2016-191483, filed Sep. 29, 2016 is expressly incorporated by reference herein.

What is claimed is:

1. A printing apparatus, comprising:

an ejection head provided with a plurality of nozzles and configured to eject a liquid from the nozzles to a paper sheet to perform printing;

a paper sheet transport roller configured to transport the paper sheet to an ejection position of the ejection head by rotating while pinching the paper sheet;

an inverting portion configured to curve and invert the paper sheet in order to print on a second surface of the paper sheet after printing on a first surface of the paper sheet;

a pinch portion configured to pinch the paper sheet with the inverting portion; and a rotation control unit configured to control rotation of the paper sheet transport roller, wherein, after printing on the first surface of the paper sheet, the rotation control unit performs a decurling process including a rotation stop control to stop rotation of the paper sheet transport roller for a predetermined time in a state in which a length from a position in which the paper sheet is pinched by the pinch portion to a forward end of the second surface of the paper sheet is equal to or shorter than a distance from a position in which the paper sheet is pinched by the paper sheet transport roller to an uppermost stream nozzle of the ejection head.

2. The printing apparatus according to claim 1, further comprising a liquid amount calculating unit configured to calculate an amount of the liquid ejected from the ejection head to the first surface of the paper sheet, wherein the inverting portion is an inversive transport roller which includes two pinch portions each of which is the pinch portion, wherein the inversive transport roller has a first pinch position in which the paper sheet is pinched by a first pinch portion, and a second pinch position in which the paper sheet is pinched by a second pinch portion and which is located upstream of the first pinch position along the inversive transport roller, and wherein, if the amount of ejected liquid calculated by the liquid amount calculating unit is equal to or greater than a predetermined threshold, the rotation control unit causes the paper sheet to be pinched in the first pinch position and performs the decurling process of the paper sheet in a state in which a first length from the first pinch position to the forward end of the second surface of the paper sheet is equal to or shorter than the distance from the position in which the paper sheet is pinched by the paper sheet transport roller to the uppermost stream nozzle of the ejection head, and, if the amount of ejected liquid calculated by the liquid amount calculating unit is less than the threshold, the rotation control unit causes the paper sheet to be pinched in the second pinch position and performs the decurling process of the paper sheet in a state in which a second length from the second pinch position to the forward end of the second surface of the paper sheet is longer than the first length.

3. The printing apparatus according to claim 2, further comprising a sheet guide configured to guide the paper sheet, which is inverted and transported by the inversive transport roller, from the second pinch position to the first pinch position in a position between the second pinch position and the first pinch position and a position facing a transport surface of the inversive transport roller, wherein, if the amount of ejected liquid calculated by the liquid amount calculating unit is less than the threshold, the rotation control unit performs the decurling process of the paper sheet in a state in which the forward end of the second surface of the paper sheet is in contact with the sheet guide.

4. The printing apparatus according to claim 3, wherein the rotation control unit performs rotation stop control to stop rotation of the paper sheet transport roller for a predetermined time.

5. The printing apparatus according to claim 4, further comprising a humidity detecting unit configured to detect humidity to which the paper sheet transported to the ejection head is exposed, wherein, if the humidity detected by the humidity detecting unit is less than a predetermined threshold, the rotation control unit performs rotation stop control to stop rotation of the inversive transport roller for a first standby time, and, if the humidity detected by the humidity detecting unit is equal to or greater than the threshold, the rotation control unit performs rotation stop control to stop rotation of the inversive transport roller for a second standby time which is shorter than the first standby time.

6. The printing apparatus according to claim 4, further comprising a basis weight acquisition unit configured to acquire a basis weight of the paper sheet, wherein, if the basis weight of the paper sheet acquired by the basis weight acquisition unit is equal to or greater than a predetermined threshold, the rotation control unit performs rotation stop control to stop rotation of the inversive transport roller for a predetermined time in a state in which the paper sheet is pinched in the first pinch position, and, if the basis weight of the paper sheet acquired by the basis weight acquisition unit is less than the threshold, the rotation control unit performs rotation stop control to stop rotation of the inversive transport roller for a predetermined time in a state in which the paper sheet is pinched in the second pinch position.

7. A printing apparatus, comprising:

an ejection head provided with a plurality of nozzles and configured to eject a liquid from the nozzles to a paper sheet to perform printing;

a paper sheet transport roller configured to transport the paper sheet to an ejection position of the ejection head by rotating while pinching the paper sheet;

an inverting portion configured to curve and invert the paper sheet in order to print on a second surface of the paper sheet after printing on a first surface of the paper sheet;

a pinch portion configured to pinch the paper sheet with the inverting portion; and a rotation control unit configured to control rotation of the paper sheet transport roller, wherein, after printing on the first surface of the paper sheet, when the paper sheet is transported by the inverting portion, the rotation control unit performs a decurling process of the paper sheet in a state in which a length from a position in which the paper sheet is pinched by the pinch portion to a forward end of the second surface of the paper sheet is equal to or shorter than a distance from a position in which the paper sheet is pinched by the paper sheet transport roller to an uppermost stream nozzle of the ejection head, the printing apparatus further comprising a liquid amount calculating unit configured to calculate an amount of the liquid ejected from the ejection head to the first surface of the paper sheet, wherein the inverting portion is an inversive transport roller which includes two pinch portions each of which is the pinch portion, wherein the inversive transport roller has a first pinch position in which the paper sheet is pinched by a first pinch portion, and a second pinch position in which the paper sheet is pinched by a second pinch portion and which is located upstream of the first pinch position along the inversive transport roller, and wherein, if the amount of ejected liquid calculated by the liquid amount calculating unit is equal to or greater than a predetermined threshold, the rotation control unit causes the paper sheet to be pinched in the first pinch position and performs the decurling process of the paper sheet in a state in which a first length from the first pinch position to the forward end of the second surface of the paper sheet is equal to or shorter than the distance from the position in which the paper sheet is pinched by the paper sheet transport roller to the uppermost stream nozzle of the ejection head, and, if the amount of ejected liquid calculated by the liquid amount calculating unit is less than the threshold, the rotation control unit causes the paper sheet to be pinched in the second pinch position and performs the decurling process of the paper sheet in a state in which a second length from the second pinch position to the forward end of the second surface of the paper sheet is longer than the first length, the printing apparatus further comprising a sheet guide configured to guide the paper sheet, which is inverted and transported by the inversive transport roller, from the second pinch position to the first pinch position in a position between the second pinch position and the first pinch position and a position facing a transport surface of the inversive transport roller, wherein, if the amount of ejected liquid calculated by the liquid amount calculating unit is less than the threshold, the rotation control unit performs the decurling process of the paper sheet in a state in which the forward end of the second surface of the paper sheet is in contact with the sheet guide, and wherein the rotation control unit performs rotation stop control to stop rotation of the paper sheet transport roller for a predetermined time, the printing apparatus further comprising a basis weight acquisition unit configured to acquire a basis weight of the paper sheet, wherein, if the basis weight of the paper sheet acquired by the basis weight acquisition unit is equal to or greater than a predetermined threshold, the rotation control unit performs rotation stop control to stop rotation of the inversive transport roller for a predetermined time in a state in which the paper sheet is pinched in the first pinch position, and, if the basis weight of the paper sheet acquired by the basis weight acquisition unit is less than the threshold, the rotation control unit performs rotation stop control to stop rotation of the inversive transport roller for a predetermined time in a state in which the paper sheet is pinched in the second pinch position.

* * * * *